US006401366B2

(12) United States Patent
Foxen et al.

(10) Patent No.: US 6,401,366 B2
(45) **Date of Patent: *Jun. 11, 2002**

(54) ATHLETIC SHOE WITH STABILIZING FRAME

(75) Inventors: Thomas Foxen, Portland; Jeffrey L. Johnson, Lake Oswego; Mark E. Cartier, Portland, all of OR (US)

(73) Assignee: Nike, Inc., Beaverton, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/293,600

(22) Filed: Apr. 16, 1999

(51) Int. Cl.[7] ..... A43B 7/14
(52) U.S. Cl. ..... 36/91; 36/102
(58) Field of Search ..... 36/91, 102, 92, 36/107, 108, 58.5, 68, 69, 76 R

(56) References Cited

U.S. PATENT DOCUMENTS

| | | | | |
|---|---|---|---|---|
| 730,366 | A | * | 6/1903 | Gunthorp |
| 892,152 | A | * | 6/1908 | Harman |
| 3,613,274 | A | * | 10/1971 | Willey |
| 4,183,156 | A | | 1/1980 | Rudy |
| 4,219,945 | A | | 9/1980 | Rudy |
| 4,316,334 | A | | 2/1982 | Hunt |
| 4,399,621 | A | | 8/1983 | Dassler |
| 4,542,598 | A | | 9/1985 | Misevich et al. |
| 4,562,651 | A | | 1/1986 | Frederick et al. |
| 4,667,425 | A | | 5/1987 | Effler et al. |
| 4,756,098 | A | * | 7/1988 | Boggia |
| 4,817,304 | A | | 4/1989 | Parker et al. |
| 4,906,502 | A | | 3/1990 | Rudy |
| 4,922,630 | A | | 5/1990 | Robinson |
| 4,922,631 | A | | 5/1990 | Anderié |
| 5,245,766 | A | | 9/1993 | Warren |
| 5,297,349 | A | | 3/1994 | Kilgore |
| 5,319,866 | A | | 6/1994 | Foley et al. |
| 5,343,639 | A | | 9/1994 | Kilgore et al. |
| 5,353,523 | A | | 10/1994 | Kilgore et al. |
| 5,400,529 | A | * | 3/1995 | Bell et al. |
| 5,465,509 | A | * | 11/1995 | Fuerst et al. |
| 5,467,537 | A | | 11/1995 | Aveni et al. |
| 5,543,194 | A | | 8/1996 | Rudy |
| 5,737,854 | A | * | 4/1998 | Sussmann |
| 5,832,634 | A | * | 11/1998 | Wong |
| 5,845,420 | A | * | 12/1998 | Buccianti et al. |
| 5,884,420 | A | * | 3/1999 | Donnadieu |
| 5,896,683 | A | | 4/1999 | Foxen et al. |
| 6,000,148 | A | * | 12/1999 | Cretinon |
| 6,006,451 | A | * | 12/1999 | Morris et al. |

* cited by examiner

*Primary Examiner*—Ted Kavanaugh
(74) *Attorney, Agent, or Firm*—Banner & Witcoff

(57) ABSTRACT

An article of footwear is disclosed having an upper secured to a longitudinal sole with a frame preferably having a stabilizing band extending between axially decoupled heel and opposite forefoot portions of the sole. The band has a central portion extending above the heel and forefoot portions of the sole and adjacent to an upper such that the forefoot and heel portions of the sole may axially pivot about a longitudinal axis parallel to and above the longitudinal axis of the heel and forefoot portions while resisting deflection in a direction perpendicular to the longitudinal length of the sole, thereby supporting a foot along its entire longitudinal length while permitting the article of footwear to conform with the axial movements of an athlete's foot while running. In a preferred embodiment, the axis of axial pivoting is the axis of pronation of a foot while running in the shoe.

25 Claims, 12 Drawing Sheets

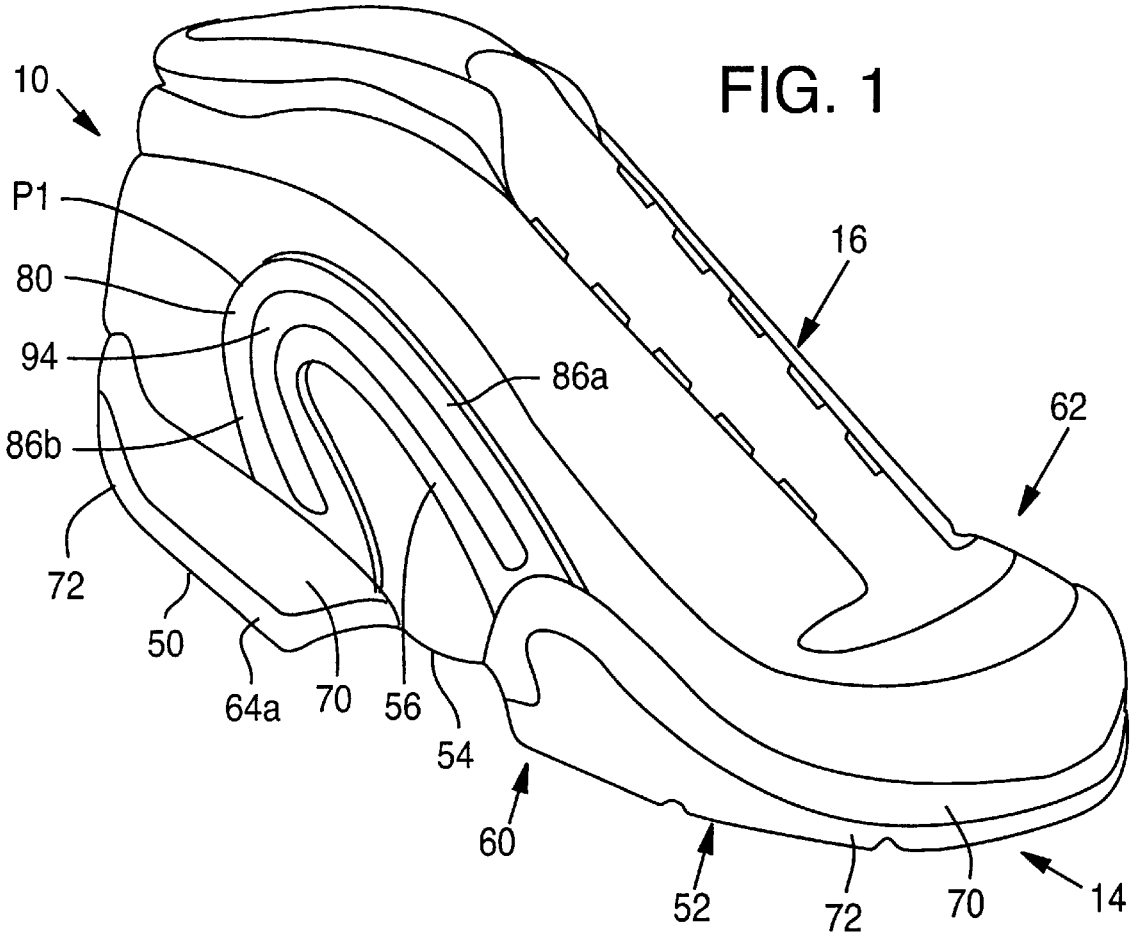
FIG. 1
FIG. 4
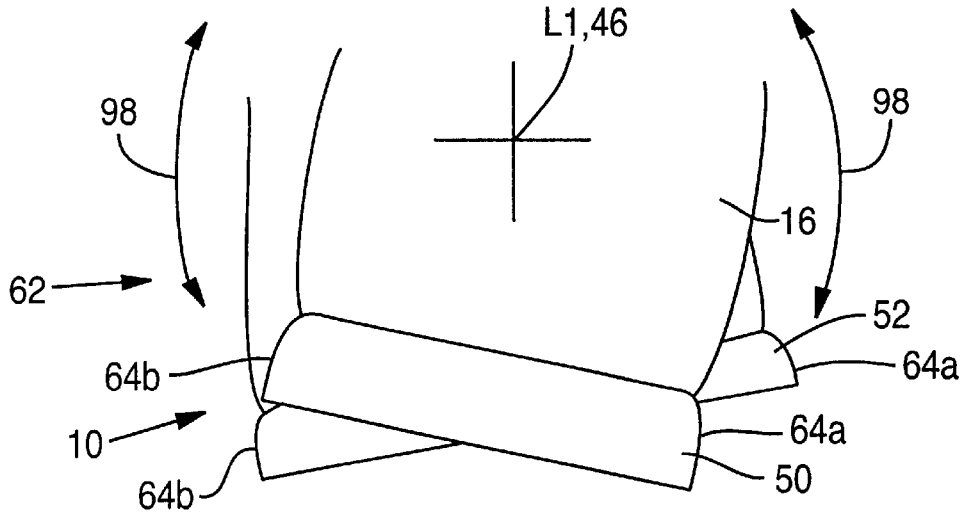

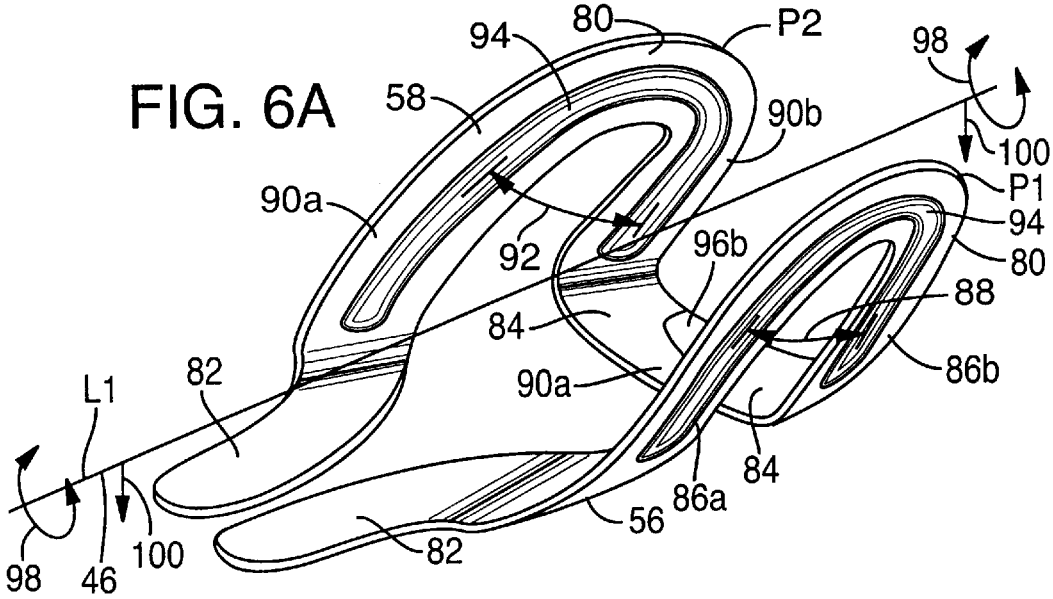
FIG. 6A
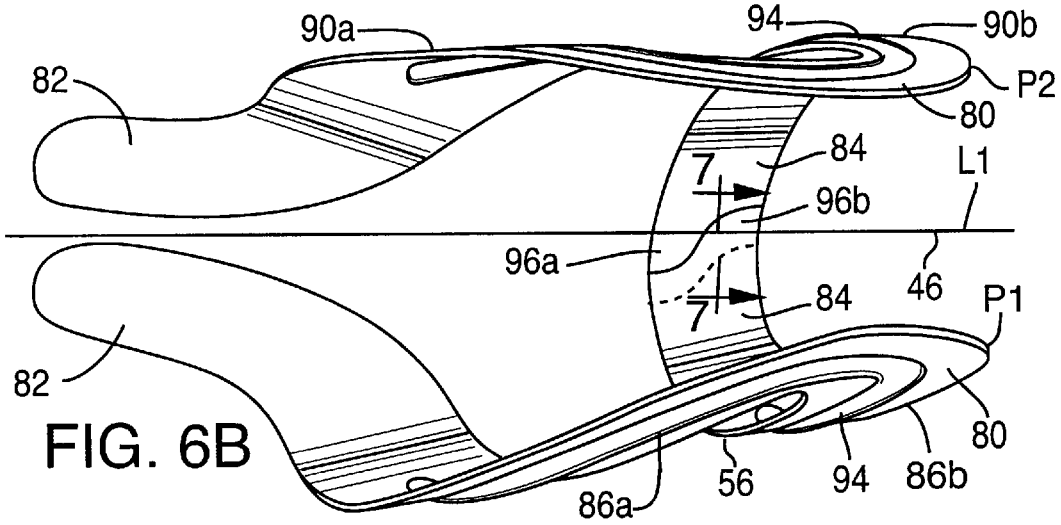
FIG. 6B
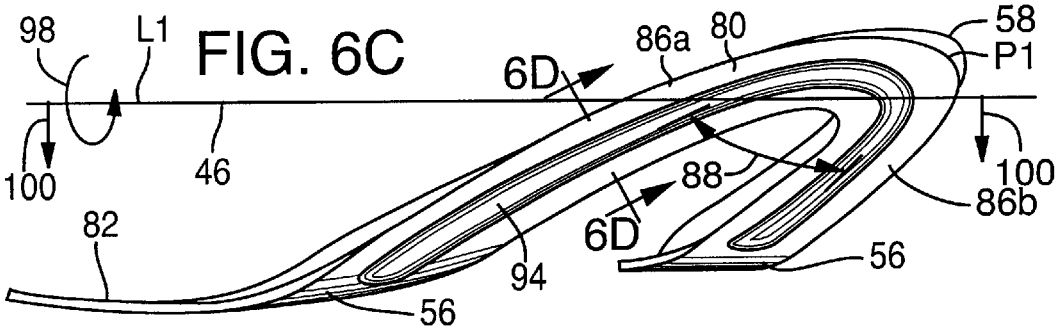
FIG. 6C
FIG. 6D
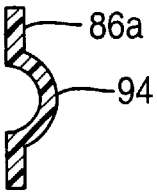
FIG. 7
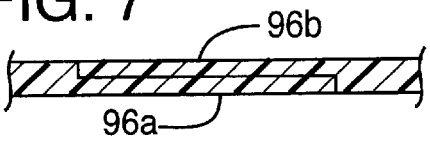

FIG. 13A
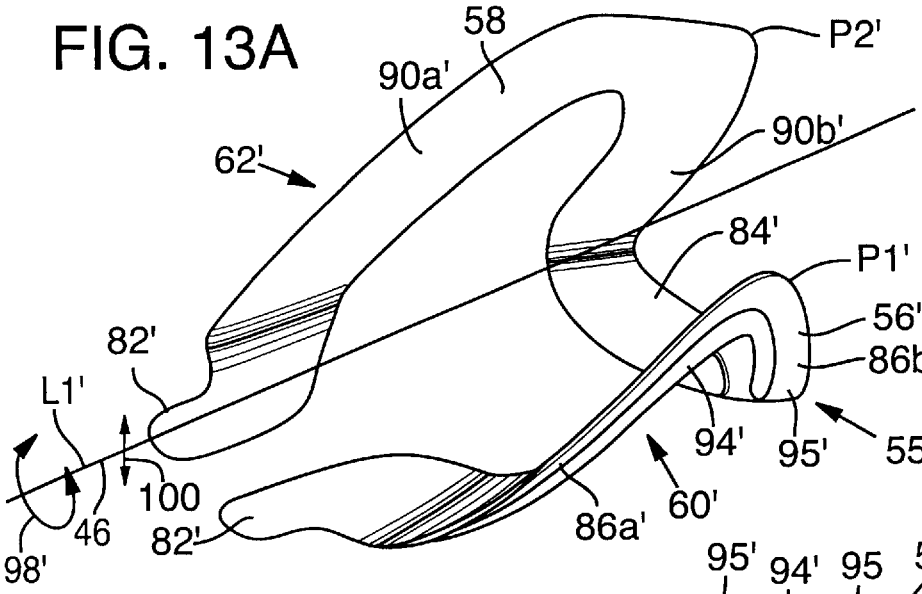
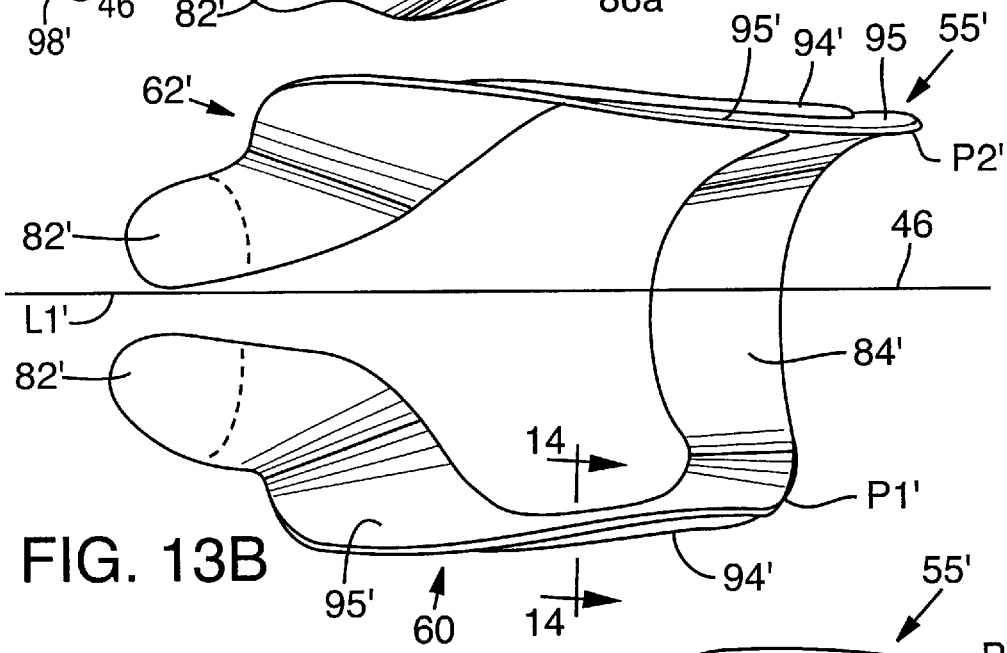
FIG. 13B
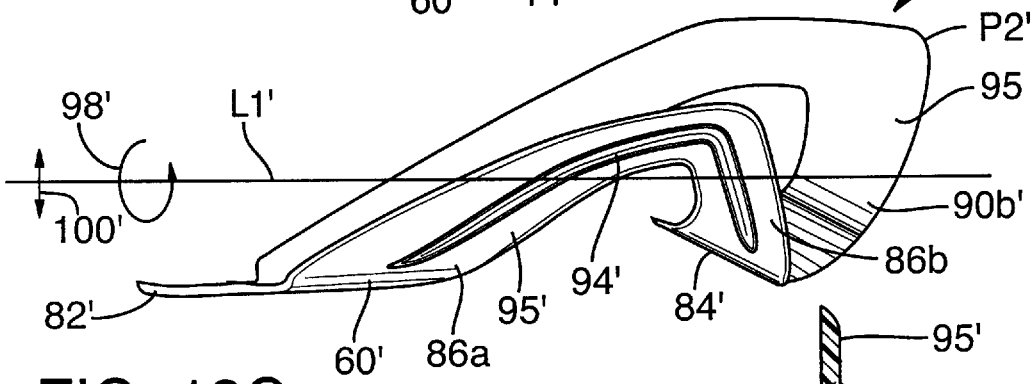
FIG. 13C
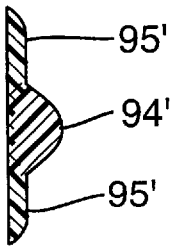
FIG. 14

ATHLETIC SHOE WITH STABILIZING FRAME

FIELD OF THE INVENTION

The present invention relates to footwear, more particularly to an athletic shoe having a stabilizing frame for flexibly decoupling heel and forefoot portions of the shoe from each other, preferably along a longitudinal axis passing substantially through the cuneiform bones of a wearer, while fully supporting a foot along its entire length.

BACKGROUND OF THE INVENTION

The modem athletic shoe is a highly refined combination of many elements which have specific functions, all of which work together for the support and protection of the foot. Athletic shoes today are as varied in design and purpose as are the rules for the sports in which the shoes are worn. Tennis shoes, racquetball shoes, basketball shoes, running shoes, baseball shoes, football shoes, walking shoes, etc. are all designed to be used in very specific, and very different, ways. They are also designed to provide a unique and specific combination of traction, support and protection to enhance performance. However, since running usually forms some portion of most sports, most athletic shoes include design elements specifically aimed at enhancing running performance.

In general, an athletic shoe is divided into two general parts, an upper and a bottom unit which contains a sole. The upper is designed to snugly and comfortably enclose the foot. Typically, the upper will have several layers including a weather and wear-resistant outer layer of leather or synthetic material, such as nylon, and a soft, padded inner layer for foot comfort.

The bottom unit provides a broad, stable base to support the foot during ground contact. The sole must also provide traction, protection, and a durable wear surface. For example, the considerable forces generated by running require that the sole provide enhanced protection and shock absorption for the foot and leg. Also, it must have an extremely durable bottom surface to contact the ground, together with a shock absorbing midsole to absorb the considerable force to which the foot and leg are subjected during the repeated ground contact which occurs during running.

The typical motion of the foot during running proceeds as follows. First, the heel strikes the ground, followed by the ball of the foot. As the heel leaves the ground, the foot rolls forward so that the toes make contact, and finally, the entire foot leaves the ground to begin another cycle. During the time that the foot is in contact with the ground, it typically is rolling from the outside or lateral side to the inside or medial side, a process called pronation. That is, normally, the outside of the heel strikes first and the toes on the inside of the foot leave the ground last. During this process, the foot rolls about an axis of pronation which is generally positioned longitudinal to the foot and extends through the cuneiform bones of the foot. This axis of pronation may be located up to several inches above the bottom surface of the foot, and there is a similar axis of pronation when walking.

Similarly, the rapid weight, foot position, and direction shifts associated with playing certain sports, such as basketball and soccer, place tremendous stress on the player's feet. To reduce the likelihood of injury and improve the player's stability, maneuverability, balance, and control during these rapid weight or direction shifts, it is desirable for the forefoot portion of a player's foot to move axially with respect to the heel portion of that foot. For example, when basketball players defend the goal and assume a fixed position on the court, they must often lean towards an approaching player while keeping their feet fixed. It is desirable for the forefoot portion of these players' feet to remain fixed on the court surface, while their heels and ankles tilt toward their respective approaching players. Similarly, when an athlete lunges sideways, it is desirable for the forefoot portion of his foot to initially remain fully positioned on the playing surface, while the heel and ankle portions of the athlete's foot tilt in the direction of the lunge.

The optimal shoe sole will facilitate these foot motions. Accordingly, it should support the foot along its entire longitudinal length, without interfering with the natural pronation of the foot while running, and flexibly decouple the forefoot and heel portions of the shoe from each other to facilitate respective axial movement of the forefoot and heel portions of the foot.

While most shoe soles support the foot, they do not provide adequate axial flexibility. For example, many midsoles and outsoles are monolithic longitudinal resilient structures extending from the heel to the toe of the shoe. The degree of stiffness of the structures determines the sole's ability to longitudinally support a foot. The structures must be rigid enough to support a foot, but flexible enough to flex and account for the rolling motion of the foot while walking and running. In practice, providing a rigid enough monolithic sole to fully support a foot along its longitudinal length, significantly limits the axial flexibility of the shoe.

One known device for supporting the foot includes positioning a stiffening plate between the midsole and outsole of the sole. The stiffening plate is usually a generally planar surface constructed of a semi-rigid, or stiff, material such as woven carbon fiber, glass filled nylon, Thermoplastic Polyurethane ("TPU"), nylon, urethane, woven glass plates, and the like, that extends longitudinally from a heel portion to a forefoot portion of the sole. The plate improves support and stability to the foot, by limiting the flexibility of the sole along an axis transverse to its longitudinal length. Accordingly, the sole remains generally rigid along its length, thereby supporting the entire foot as it rolls from its heel to toe while running or walking. While a sole having a known stiffening plate may slightly flex axially about its longitudinal length, the degree of axial flexibility is generally not sufficient to prevent interfering with the natural pronation of the foot.

Structures that address the overall design of athletic shoe stiffening plates and their axial flexibility have been disclosed in prior art patents. For example, U.S. Pat. No. 4,922,631 to Anderie discloses using a longitudinal stiffening member positioned along the longitudinal centerline of the sole of a shoe. The member extends between a front sole portion and a rear sole portion, which are separated by recesses. As a result, the front sole portion can twist relative to the rear sole portion about the longitudinal axis of the stiffening member. However, this axis of rotation is positioned within the sole, several inches below the axis of pronation of the foot. Accordingly, when an athlete runs in such shoes having known stiffening plates in them, each foot will attempt to pivot about its axis of pronation, while the shoe pivots about the longitudinal axis of the stiffening plate. This displacement of the two axes with respect to each other results in several problems. For example, the foot may rub or slip within the shoe contributing to heel slippage, excessive friction heat build-up, and abrasion of the foot. Also, depending on how the foot interacts with the shoe, the mobility of the foot may be compromised, thereby limiting an athlete's range and power.

In a more recent patent, the weight of athletic shoes is reduced by removing a portion of the sole adjacent to a central arch region and replacing it with a light weight arch support member spanning between an aft heel region and a forefoot region of the sole. See, U.S. Pat. No. 5,319,866 to Foley et al. While such arch support members may allow the removal of non-essential sole material, they do not axially decouple the heel portion from the forefoot region of the sole. Therefore, they do not improve the axial flexibility of the shoe, nor facilitate natural pronation.

Thus, despite the known prior art techniques, there remains a need for a light weight athletic shoe that facilitates natural pronation of a foot and axial flexibility while still fully supporting the foot along its entire longitudinal length.

SUMMARY OF THE INVENTION

The athletic shoe according to the present invention includes an upper secured to a sole having a heel portion, an opposite forefoot portion, and a stabilizing frame or member extending between these portions operably securing them to each other. The stabilizing member preferably includes a central portion extending above the heel and forefoot portions and is shaped to allow the two portions to move with respect to each other generally axially about a longitudinal axis above the heel and forefoot portions while enhancing the rigidity of the shoe along its length.

In one preferred embodiment, two stabilizing members are secured to the sole portions, and the heel and forefoot portions move with respect to each other generally axially about an axis of pronation of a foot wearing the shoe. One member is positioned on the medial side of the sole while the other member is positioned on the lateral side of the sole.

The central portion of each stabilizing member is generally c-shaped which extends between flat fore and aft sole mounting portions. The mounting portions lie in substantially in the same plane with each other, and the central portion extends upwardly and outwardly from the mounting portions, conforming with and adjacent to the upper.

The fore sole mounting portion of the medially mounted stabilizing member is preferably positioned so that it occupies a space below the first metatarsal head of a foot. It's central portion sweeps upwardly and backwardly adjacent to the medial side of the foot so that it occupies a space adjacent to the arch area of the foot following a generally arcuate path to a turn-around point below the medial side of the ankle. It then sweeps downward so that the aft sole mounting portion is positioned under the heel on the medial side of the foot.

Similarly, the fore sole mounting portion of the laterally mounted stabilizing member is preferably positioned so that it occupies a space below the second and third metatarsal head of a foot. It's central portion sweeps upwardly and backwardly adjacent to the lateral side of the foot so that it follows a generally arcuate path to a turn-around point below the lateral side of the ankle. It then sweeps downward so that the aft sole mounting portion is positioned under the heel on the lateral side of the foot. Each stabilizing member preferably includes a stiffening rib to enhance rigidity of the shoe in a direction horizontally transverse to the longitudinal axis of the sole.

When the foot of a typical runner wearing a shoe of the present invention contacts the ground along the lateral heel area, the heel portion and forefoot portions of the sole decouple or pivot with respect to each other such that they axially move with the foot about the foot's axis of pronation. Similarly, during the rapid, weight and direction shifts associated with playing certain sports such as soccer or basketball, the athlete's forefoot and corresponding forefoot portion of his shoe freely move axially with respect to the heel portion of his foot and shoe. However, the foot remains fully supported along its entire longitudinal length. Moreover, because the stabilizing members longitudinally support the arch of the foot, the need for heavy and durable sole material in the arch area is minimized, thereby resulting in a light weight and more economical shoe.

Various advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there are illustrated and described preferred embodiments of the invention.

BRIEF DESCRIPTION OF THE DRAWINGS

FIG. 1 is an isometric view of a shoe having stabilizing bands in accordance with a first preferred embodiment of the present invention.

FIG. 4 is a rear plan view of the shoe of FIG. 1 showing possible axial movement of the forefoot and heel portions of the shoe with respect to each other.

FIG. 6A is an enlarged isometric view of the stabilizing band of FIG. 1.

FIG. 6B is top plan view of the stabilizing band of FIG. 6A.

FIG. 6C is aside plan view of the stabilizing band of FIG. 6A.

FIG. 6D is an enlarged cross-sectional view taken along line 6D—6D of FIG. 6C.

FIG. 7 is an enlarged cross-sectional view taken along line 7—7 of FIG. 6B.

FIG. 13A is an enlarged isometric view of the stabilizing band of FIG. 8. side plan view of the shoe of FIG. 8

FIG. 13B is a an enlarged top plan view of the stabilizing band of FIG. 8.

FIG. 13C is an enlarged side plan view of the stabilizing band of FIG. 8.

FIG. 14 is an enlarged cross-sectional view taken along line 14—14 of FIG. 13B.

DETAILED DESCRIPTION OF THE PREFERRED EMBODIMENTS

An article of footwear having an improved stabilizing band or frame is disclosed. A first preferred embodiment is disclosed in FIGS. 1–7, a second preferred embodiment is disclosed in FIGS. 8–14, and a third preferred embodiment is disclosed in FIGS. 15–16.

A. First Preferred Embodiment

Referring to FIGS. 1–7, wherein like numerals indicate like elements, an article of footwear in accordance with a first preferred embodiment of the present invention, such as an athletic shoe, is generally shown as 10. Shoe 10 for receiving a human foot 12 includes a sole structure 14 and an upper 16 attached to it. Upper 16 can be of any conventional design, and preferably is flexible and includes attaching devices (not shown), such as loops and a shoe lace or a zipper for detachably, but snugly, securing the upper to the foot. Sole structure 14 and upper 16 incorporate novel features of the present invention.

Figure 2:
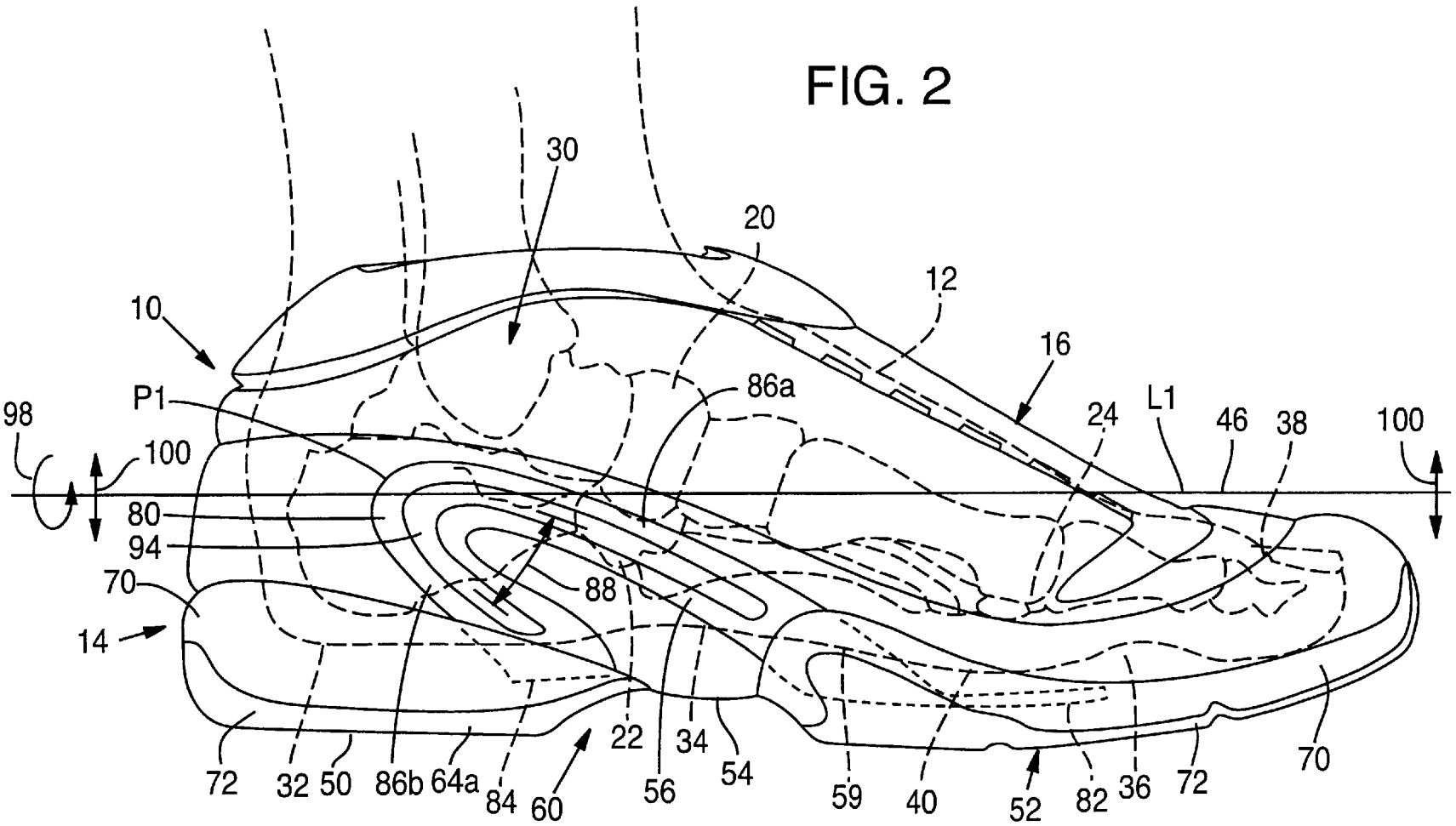
FIG. 2 is a side plan view of the shoe of FIG. 1 with the outline of the medial view of a foot provided to show possible orientation the shoe with respect to an athlete's foot.
Figure 3:
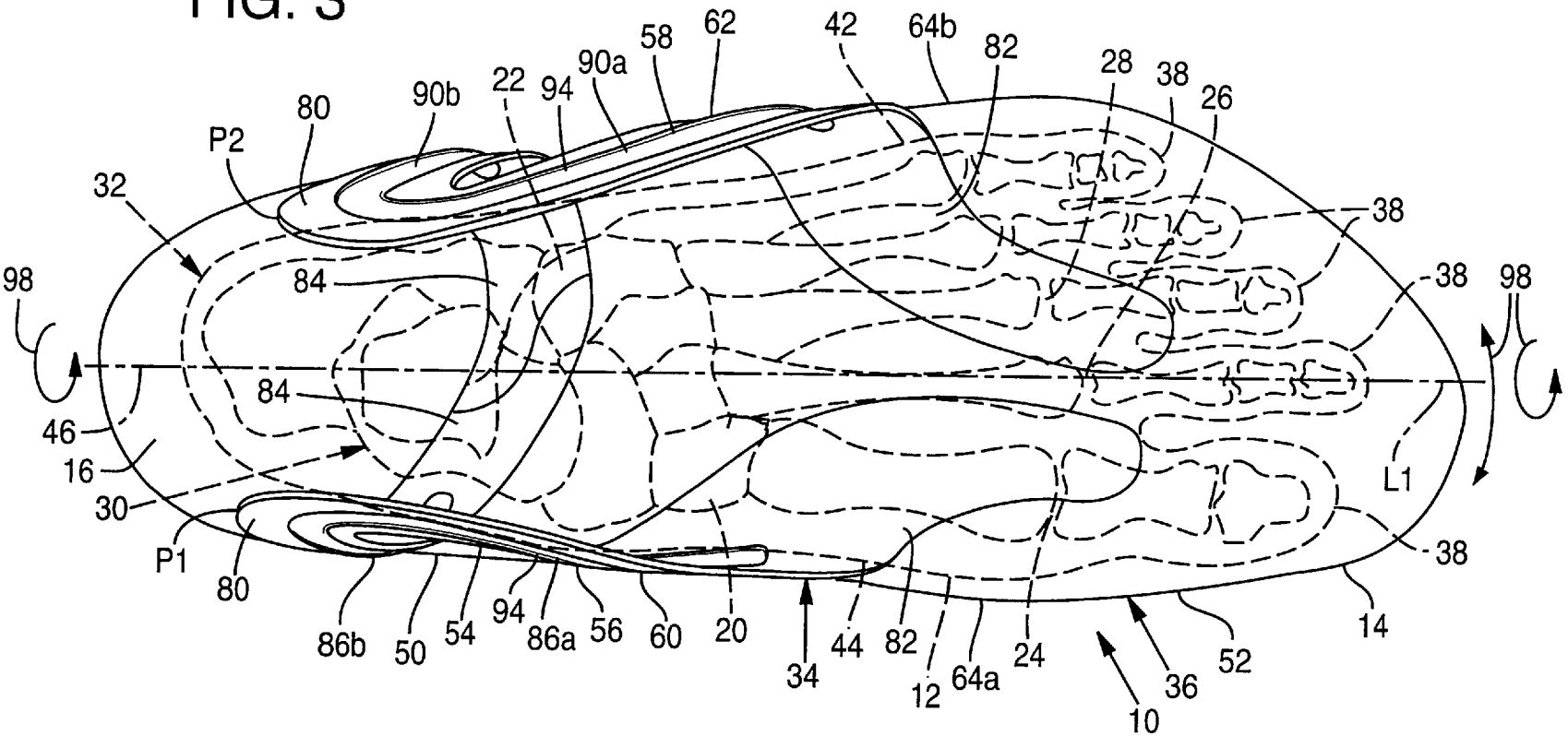
FIG. 3 is a top plan view of the shoe and foot outline of FIG. 2.

As shown in outlined format in FIGS. 2 and 3, human foot 12 contains twenty six bones including first cuneiform 20, cuboid 22, first metatarsal, second metatarsal, and third metatarsal heads 24, 26, and 28, respectively. These twenty-six bones join together to generally define an ankle area 30, heel area 32, arch area 34, and forefoot area 36 including the toes 38. As previously described, the typical motion of the foot 12 during running proceeds such that the heel area 32 strikes the ground, followed by the ball 40 of the foot 12. More specifically, as the heel area 32 leaves the ground, the foot 12 rolls forward about the arch area 34 so that the toes 38 make contact, and finally, the entire foot 12 leaves the ground to begin another cycle. During the time that the foot 12 is in contact with the ground, it typically is rolling from the outside or lateral side 42 to the inside or medial side 44, a process called pronation. During this process, the forefoot area 36 of the foot rolls about an axis of pronation 46 which is generally positioned longitudinal to the foot and extends through the cuneiform bones 20 of the foot 12. This axis of pronation 46 may be located up to several inches above the bottom surface 59 of the foot 12.

Similarly, the forefoot area 36 and heel area 32 naturally pivot axially with respect to each other along the axis of pronation 46 during the rapid weight, foot position, and direction shifts, associated with playing certain sports, such as basketball and soccer. For example, when a basketball player lunges from side-to-side, the forefoot area 36 initially remains flat with the playing surface while the heel area axially 32 pivots about the axis of pronation 46 in the direction of the lunge.

As best shown in FIGS. 1–3 and 5, sole structure 14 includes a heel portion 50, an opposite forefoot portion 52, arch portion 54, and frame 55, preferably including a first or medial stabilizing member 56 and a second or lateral stabilizing member 58. The stabilizing members 56, 58 are positioned adjacent to the arch portion 54 of the sole structure 14 and extend between the heel and forefoot portions 50, 52, respectively, operably securing them to each other. The heel, arch, and forefoot portions 50, 54, 52, respectively, divide sole structure 14 into relative sections related generally to the correspondingly named areas of the foot 12. As shown in FIG. 3, longitudinal centerline L1, which is generally parallel to the axis of pronation 46, divides the sole structure 14 into a medial side 60 and lateral side 62. Medial stabilizing member 56 is positioned on the medial side 60 of the sole structure 14 adjacent to sole outer edge 64*a*, and lateral stabilizing member 58 is positioned on the lateral side 62 of the sole structure 14 adjacent to sole outer edge 64*b*.

In the first preferred embodiment, the heel portion 50 and forefoot portion 52 are preferably independent, separately formed structures with each structure including a cushioning or force absorbing midsole 70 and a flexible, wear resistant outsole 72. Each midsole 70 is formed of a cushioning, resilient foam material, such as a polyurethane foam into which a sealed resilient insert (not shown) may be encapsulated. The insert is preferably a gas-filled bladder or chamber formed according to the teachings of U.S. Pat. Nos. 4,183,156, 4,219,945, 4,906,502, 5,543,194 to Marion F. Rudy, the disclosures of which are hereby incorporated by reference. Such a gas-filled bladder is formed from a flexible material which is sealed along its perimeter and at preselected locations within its perimeter which, after being filled to a relatively high pressure by a gas having a low diffusion rate through the flexible material, takes on a generally flat bladder configuration. The bladder is thereafter encapsulated in the foam material comprising the remainder of the midsole. Alternatively, the insert can be omitted and the entire midsole 70 can be formed of a cushioning foam material or columns of cushioning material such as disclosed in U.S. Pats. Nos. 5,343,639 and 5,353,523 to Kilgore et al., the disclosures of which are hereby incorporated by reference. In any case, the midsoles function as a compressible and resilient unit which cushions foot impact.

The arch portion 54 of the sole structure 12 includes a flexible light weight material, such as the same material of the upper 16. Alternatively, it may include a protective material, such as rubber to protect the arch area 34 of the foot 12 and provide a water resistant surface along the entire lower surface 74 (FIG. 5) of the sole structure 14. The material in the arch portion 54 is preferably more flexible than the heel and forefoot portions 50, 52, respectively, to permit these sole portions to easily move with respect to each other. Moreover, since the arch portion 54 material is lighter than the materials comprising the heel and forefoot portions 50, 52, respectively, the sole is lighter than traditional monolithic or unibody sole constructions. Alternatively, the same materials as used in the heel and forefoot portions 50, 52, respectively, may be used in the arch portion 54 of the sole, with the arch portion 54 including cut-outs (not shown), slits (not shown), or a narrow width 76 (FIG. 12) to facilitate axial flexibility between the heel and forefoot portions 50, 52, respectively.

Figure 5:
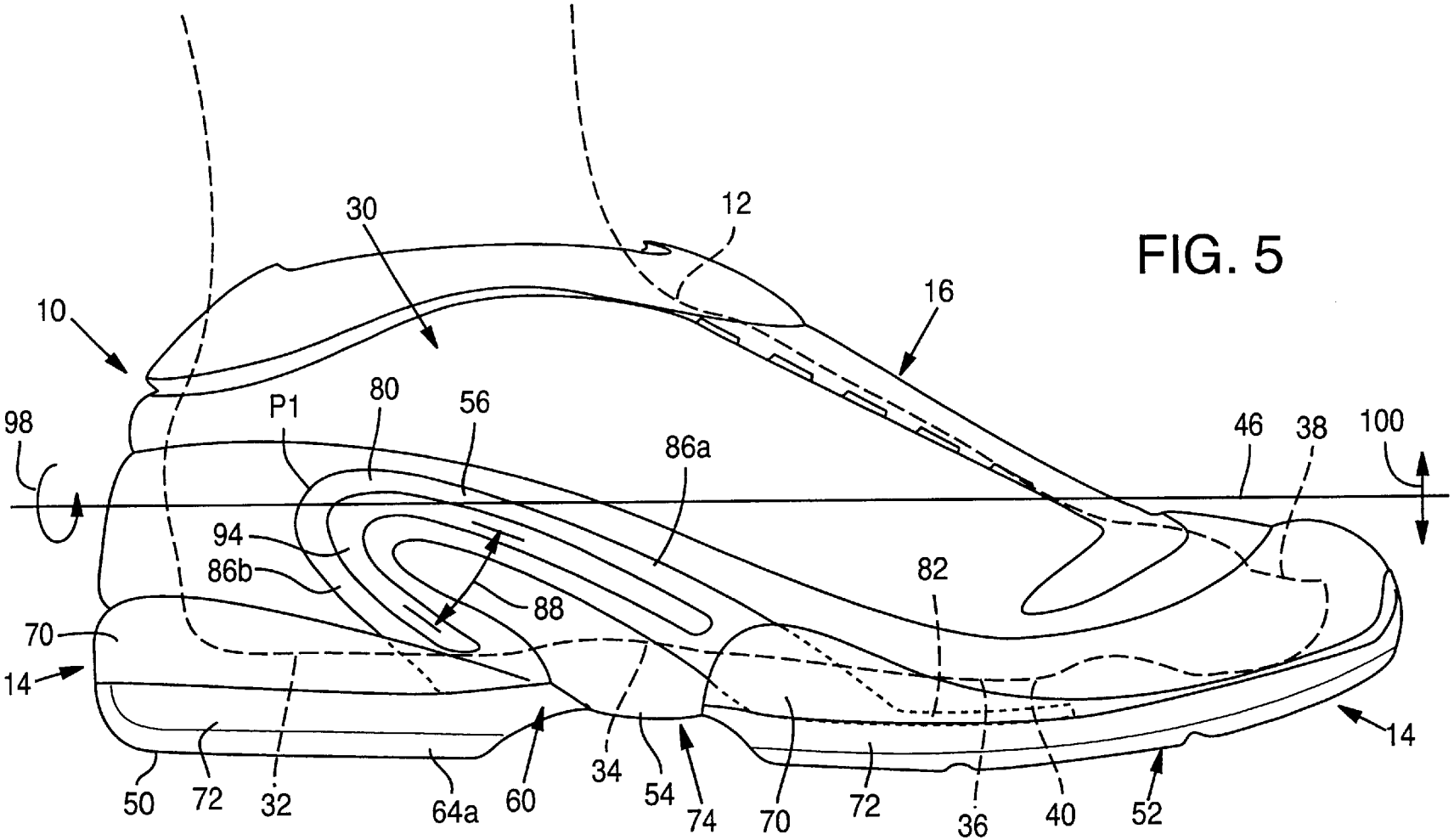
FIG. 5 is a side plan view of the sole and stabilizing bands of the shoe of FIG.
Figure 8:
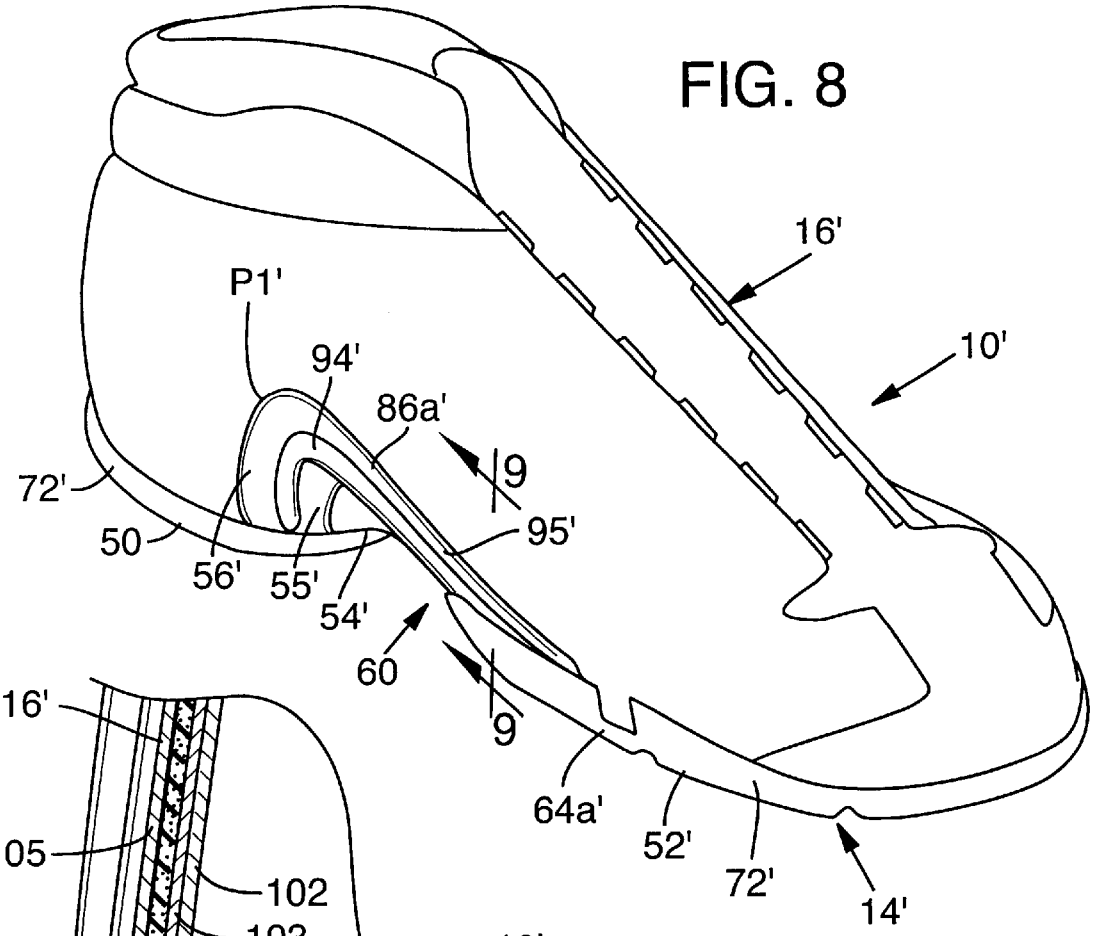
FIG. 8 is an isometric view of a shoe having a monolithic stabilizing band in accordance with a second preferred embodiment of the present invention.

The medial and lateral stabilizing members 56, 58, respectively, have a similar shape and construction. Accordingly, to prevent unduly complicating the present disclosure, only the medial stabilizing member 56 is shown in FIG. 5. In general and as best shown in FIG. 5, each stabilizing member 56, 58 is preferably a thin band of light weight, semi-rigid, but resilient material, preferably having a flex modulus between 10,000–300,000 psi and a Shore hardness between 40–65 D. More preferably, the Shore hardness is between 50–65 D. Materials having such properties include single and dual molded Thermoplastic Polyurethane ("TPU"), Nylon Acrylonitrile Butadienne Stryrene ("ABS"), other reinforced injection molded materials, and the like. Preferable materials include a TPU product sold under the product name TEXIN and a Nylon ABS product sold under the product name TRIAX by the Bayer Corporation.

The stabilizing members 56, 58, include a generally c-shaped portion 80 which extends between flat fore and aft sole mounting portions 82, 84, respectively. The mounting portions 82, 84 lie in substantially in the same plane with each other, and the central portion 80 extends upwardly and outwardly from the mounting portions 82, 84. As best shown in FIGS. 1 & 3, the central portion 80 of both stabilizing members 56, 58 conform with and are positioned adjacent to the sides of upper 16. Preferably, the respective central portions 80 are secured directly to the upper 16 with known materials and methods, such as applying cements or adhesives. More preferably, the upper portions include a thin layer of padding (not shown), particularly in the area adjacent to the stabilizing members 56, 58, to improve wearer comfort.

Supporting a foot 12 between its metatarsal heads 24, 26, 28 and heel area 32 fully supports the arch area 34 of the foot. Preferably, a sock liner (not shown) having a padded arch support and foot support (not shown) is inserted in the shoe adjacent to the midsole to further support the arch area 34 of the foot. Accordingly and as best shown in FIG. 3, the fore mounting portion 82 of the medial stabilizing member 56 is preferably sized and shaped to attach to the forefoot portion 52 of the sole structure 14 such that it occupies a space below the first metatarsal head 24 of the foot 12. As best shown in FIGS. 2 and 6A–C, it's central c-shaped portion 80 generally defines two arms 86*a*, 86*b*. Arm 86*a* sweeps upwardly and backwardly generally along the arch 87 (FIG. 2) of the foot 12 to point P1 adjacent to the medial side of the upper 16 so that it occupies a space adjacent to the arch area 34 of the foot 12 following a generally arcuate path. Preferably, point P1 is above the heel and forefoot portions 50, 52, respectively, and below the medial side of the ankle area 30. Arm 86*b* of the central portion 80 then sweeps downward from point P1 so that the aft mounting portion 84 is positioned under the heel area 32 on the medial side of the foot 12 generally defining angle 88 between arms 86*a*, 86*b* about point P1.

Similarly and as best shown in FIG. 3, the fore mounting portion 82 of the lateral stabilizing member 58 is shaped and sized to attach to the forefoot portion 52 of the sole structure 14 so that it occupies a space below the second and third metatarsal heads 26, 28, respectively, of foot 12. As shown in FIGS. 6A–6C, its central c-shaped portion 80 generally defines two arms 90*a*, 90*b*. Arm 90*a* sweeps upwardly and backwardly to point P2 adjacent to the lateral side of the upper 16 so that it follows a generally arcuate path. Preferably, this point P2 is generally horizontally parallel to point P1 and above the heel and forefoot portions 50, 52 and below the lateral side of the ankle area 30. Arm 90*b* of the central portion 80 then sweeps downward from point P2 so that the aft mounting portion 84 is positioned under the heel on the medial side of the foot generally defining angle 92 between arms 90*a*, 90*b* about point P2. preferably angle 92 is substantially the same as angle 88.

The c-shaped portions 80 of each stabilizing member may include a stiffening rib 94 to enhance rigidity of the shoe 10 along its length, or more specifically, in a direction horizontally transverse to the longitudinal axis of the sole.

Preferably, and as best shown in FIGS. 6B and 7, the aft mounting portions of each stabilizing member include curvilinear engaging portions 96*a*, 96*b* for securing and properly aligning the two stabilizing members 56, 58 to each other. More preferably, the mounting portions 82, 84 of each stabilizing member are secured between the midsole 70 and outsole 72 of their corresponding sole portions 52, 50, respectively, with known materials and methods. Specifically, the aft mounting portions 84 are secured between the midsole 70 and outsole 72 of the heel portion 50 of the sole 14, and the fore mounting portions 82 are mounted between the midsole 70 and outsole 72 of the forefoot portion 52 of the sole 14, by adhesive.

The generally c-shaped portion 80 of each stabilizing member 56, 58, when constructed and assembled as shown in FIGS. 2–7, allow the fore and aft mounting portions 82, 84 to axially twist with respect to each other in the direction of arrows 98 (FIGS. 4, 5, 6A and 6B) generally about axis L1, but resist movement in a direction of arrow 100 (FIGS. 2, 6A and 6B), generally transverse to a longitudinal length extending between said fore and aft mounting portions. The height of points P1 and P2 above the sole of the shoe determine the location of the axial axis L1 of rotation between the mounting portions.

When the stabilizing members 56, 58 are installed as described between the forefoot and heel portions 52, 50 of the sole 14, these sole portions 52, 50 may axially twist with respect to each other about axis L1 (FIG. 2), but resist movement in the direction of arrow 100 (FIG. 2). As a result, the forefoot and heel portions 52, 50 of the sole may axially pivot about an axis L1 located above the sole 14 of the shoe 10, while the sole 14 remains fully supported along its longitudinal length. Preferably, the height of points P1 and P2 above the sole are selected so that axis L1 aligns with the axis of pronation 46 of the foot wearing the shoe.

B. Second Preferred Embodiment

Referring to FIGS. 8–14, an article of footwear in accordance with a second preferred embodiment of the present invention, such as an athletic shoe, is generally shown as 10'. Like numerals indicate like elements, with like elements between the first and second preferred embodiments having like numerals.

Shoe 10' for receiving a human foot 12 includes a sole 14' and an upper 16' attached to it. Sole 14' includes a heel portion 50', an opposite forefoot portion 52', arch portion 54', and a frame or stabilizing member 55'to facilitate axial flexibility of the sole 14'. The sole 14' includes a cushioning or force absorbing midsole 70' and a flexible, wear resistant outsole 72' of the same construction as previously described with respect to the heel and forefoot portions 50, 52 (FIG. 2) of the sole of the first preferred embodiment.

Figure 12:
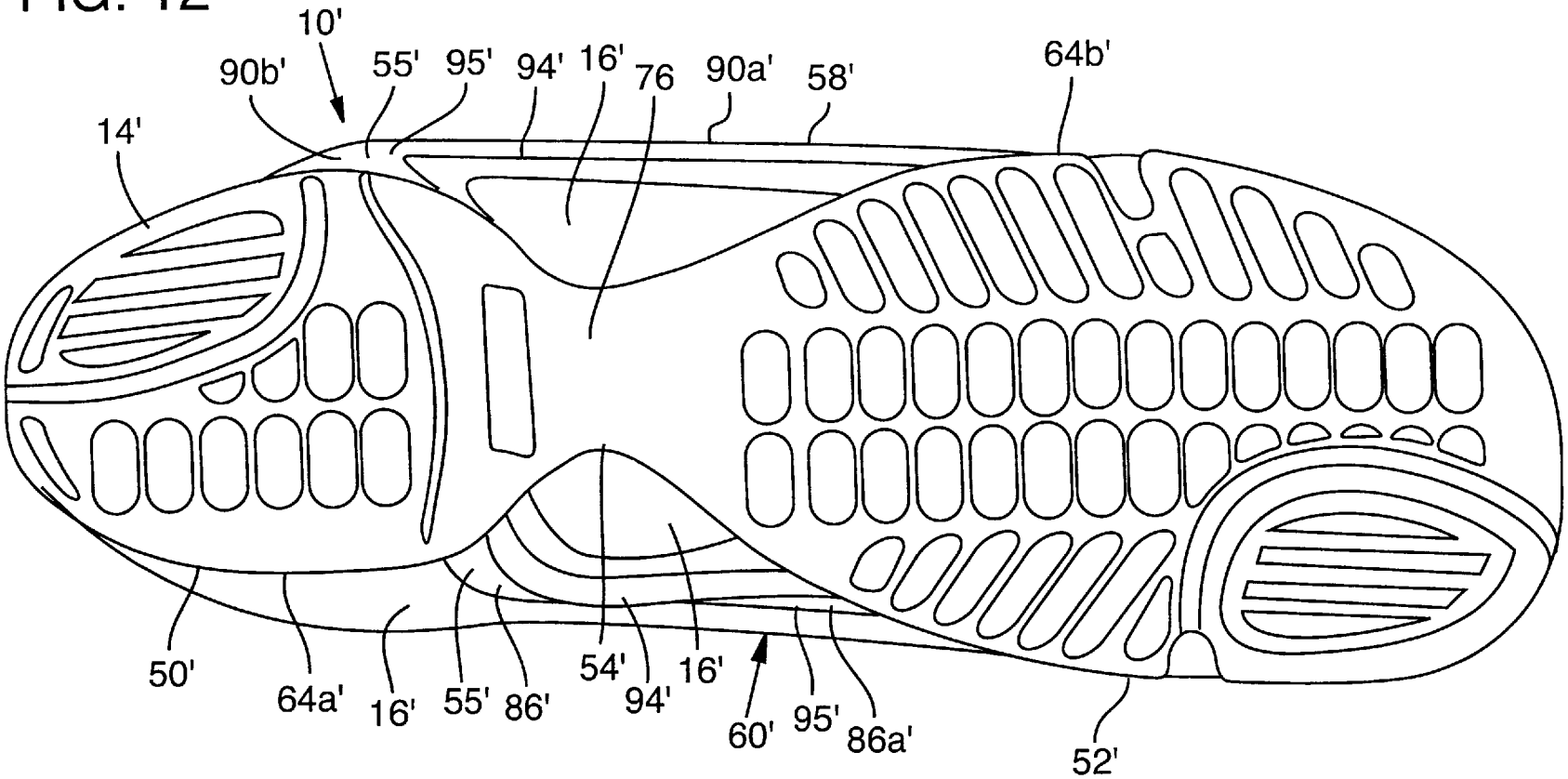
FIG. 12 is a bottom plan view of the shoe of FIG. 8.

In situations where the article of footwear may be worn for more than engaging purely in athletic activities on hazard free playing fields, it is desirable to protect the arch area 34 of the foot 12 with debris protecting material, such as outsole material Similarly, for ease of aligning the midsole 70' and outsole 72', it is desirable for these structures to be monolithic structures. Accordingly and as best shown in FIG. 12, sole 14 preferably includes a continuous outsole 72' and midsole 70' structure extending from the heel portion 50' to the forefoot portion 52'. The arch portion 54' has only a thin and narrow band of outsole 72' and midsole 70' material, thereby promoting axial flexibility in the arch portion 54'.

Figure 10:
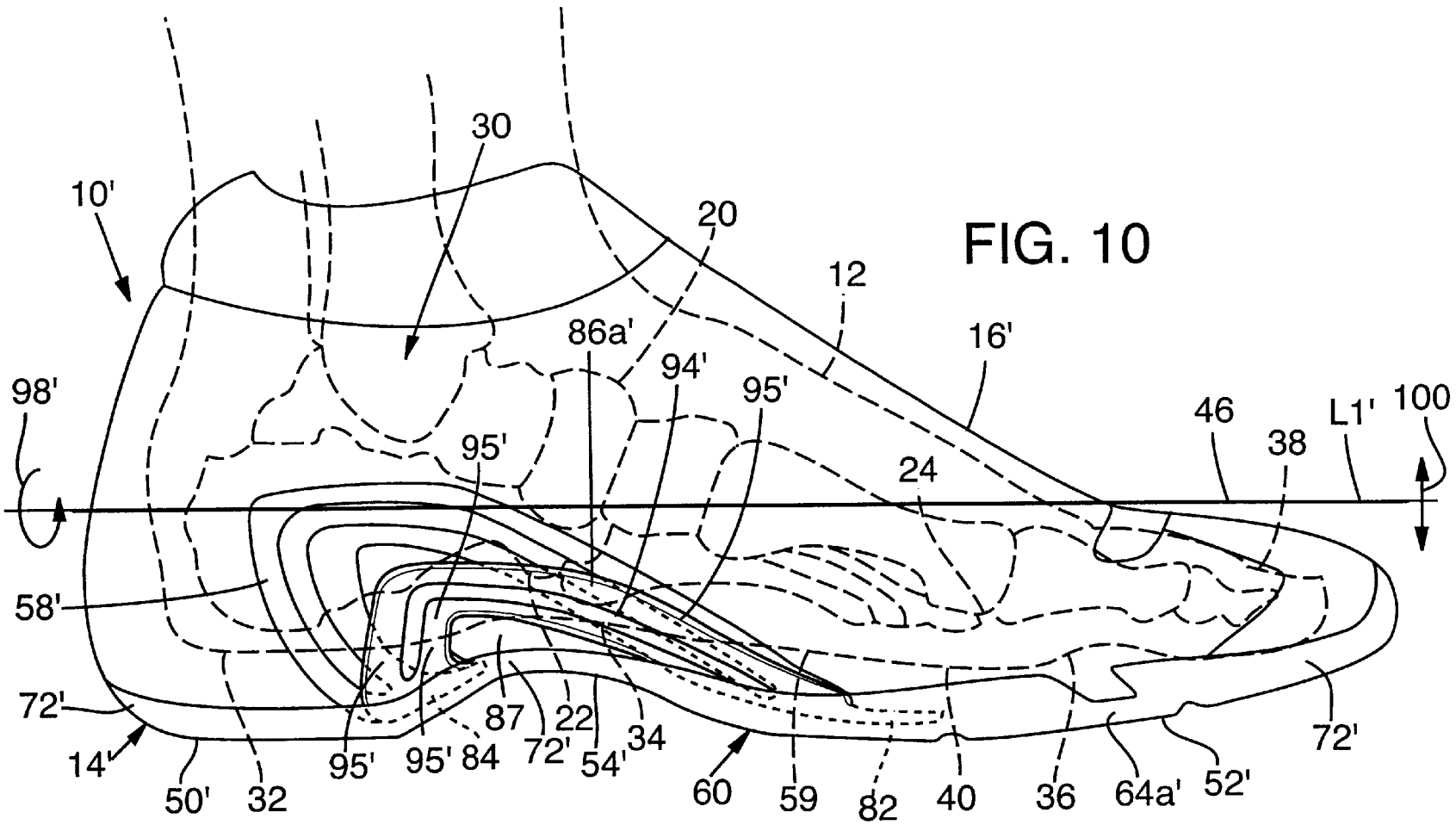
FIG. 10 is a side plan view of the shoe of FIG. 8 with the outline of the medial view of a foot provided to show possible orientation the shoe with respect to an athlete's foot.
Figure 11:
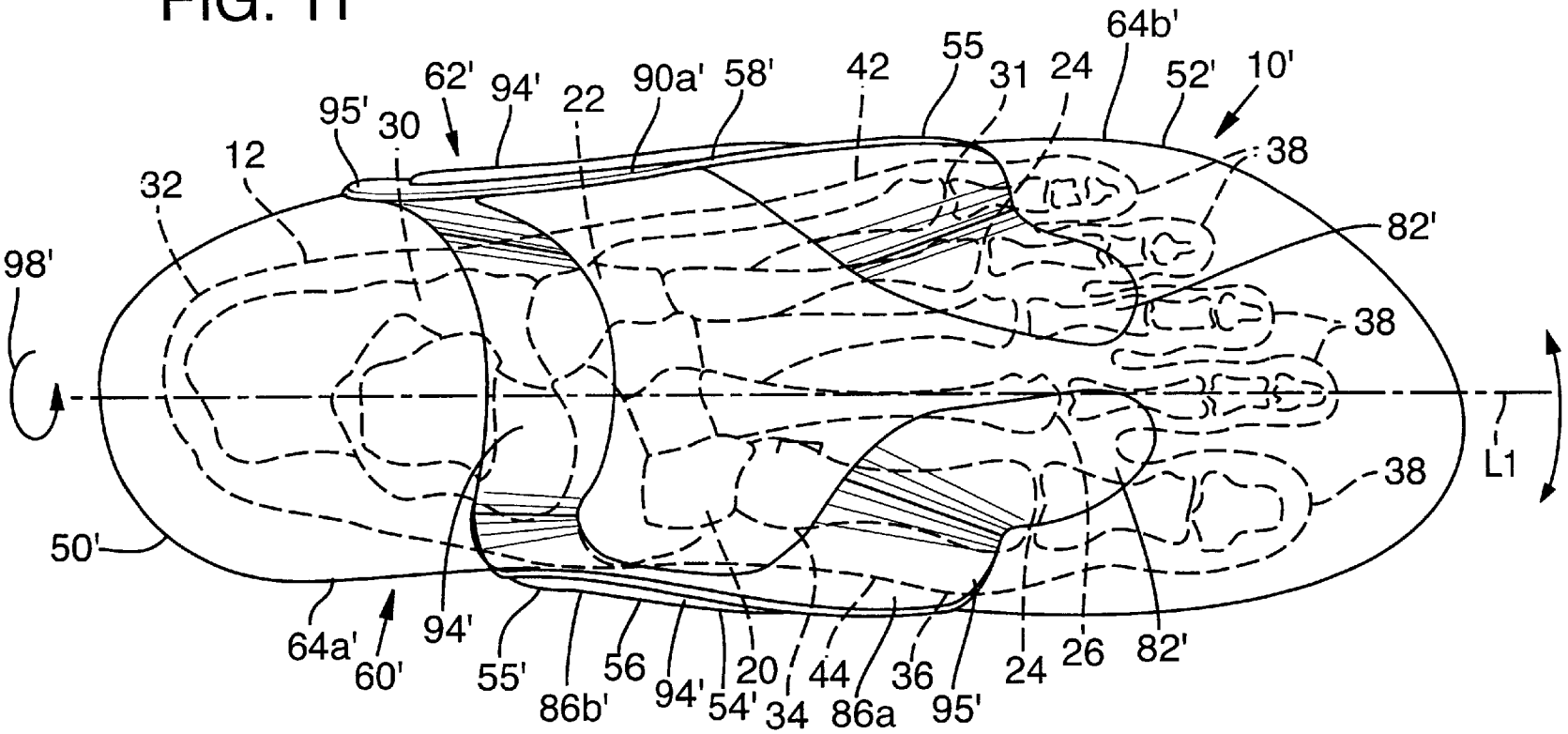
FIG. 11 is a top plan view of the shoe and foot outline of FIG. 10.

As best shown in FIGS. 10–12, the stabilizing member 55' is positioned adjacent to the arch portion 54' of the sole 14' and extends between the heel and forefoot portions 50', 52', respectively, operably securing them to each other. The stabilizing member 55' is preferably a unitary or monolithic structure having a first or medial generally c-shaped portion 56' and a second or lateral generally c-shaped portions 58'. These portions 56', 58' are joined to a generally planar aft mounting portion 84'. The opposite end of each c-shaped portion 56', 58' includes a generally planar fore mounting portion 82*a*', 82*b*', respectively.

As best shown in FIG. 11, fore mounting portion 82*a*' of the medial c-shaped portion 56' is preferably sized and shaped to attach to the forefoot portion 52' of the sole 14' such that it occupies a space below the first and second metatarsal heads 24, 26 of the foot 12. The fore mounting portion 82*b*' of the lateral stabilizing member 58' is shaped and sized to attach to the forefoot portion 52' of the sole 14' so that it occupies a space below the third, fourth, and fifth metatarsal heads 28, 29, 31, respectively, of foot 12. As best shown in FIG. 11, aft mounting portion 84' is positioned under the heel portion 50'.

As with the first embodiment, the medial c-shaped portion 56' preferably defines two arms 86*a*', 86*b*'. Arm 86*a*' sweeps upwardly and backwardly above the sole 14' and generally along the arch 87 of the foot to point P1' adjacent to the medial side 60' of the upper 16' so that is occupies a space adjacent to the arch area 34 of the foot 12 following a generally arcuate path. Preferably, point P1' is above the sole 14' and below the medial side 44 of the ankle area 30. Arm 86*b*' sweeps downward from point P1' to the aft mounting portion 84'. Similarly, the lateral c-shaped portion 58' defines two arms 90*a*', 90*b*'. Arm 90*a*' sweeps upwardly and backwardly to point P2' adjacent to the lateral side 62' of upper 16' so that it follows a generally arcuate path. Preferably, point P2' is above the sole 14' and below the lateral side 42 of the ankle area 30. More preferably, and referring specifically to FIG. 13C, point P1' is forward of and below point P2' as shown. Arm 90*b*' sweeps downward from Point P2' to the aft mounting portion 84'.

The c-shaped portions 56', 58' preferably include a stiffening rib 94' to enhance rigidity of the shoe 10' along its length, or more specifically, in a direction horizontally transverse to the longitudinal axis of the sole 14'. In such case, each c-shaped portion 56', 58' will include the stiffening rib 94' and an adjacent band portion 95'.

Preferably, the stabilizing member 55' is a thin band of light weight, semi-rigid, but resilient material, having a flex modulus between 10,000–300,000 psi and a Shore hardness between 40–65 D. As previously described, materials having such properties include molded TPU, Nylon ABS, other reinforced injection molded materials, and the like. More preferably and from a comfort perspective, the stabilizing member 55' is dual molded. In such case and as best shown in FIG. 14, the stiffening rib 95' is molded with a first material having a higher flex modulus than the second material in the adjacent band portion 95'. Desirable combinations of such first and second materials include selecting a first material having a flex modulus between 150,000–250,000 psi and a second material having a flex modulus between 10,000–40,000 psi with a Shore hardness between 40–65 D. More preferably, the Shore hardness is between 50–65 D. Preferable materials include using a Nylon ABS glass-filled product sold under the name TRIAX by the Bayer Corporation as the first material, and using a TPU product sold under the product name TEXIN by the Bayer Corporation as the second material. Known preferred types of TRIAX specifically include products sold by the Bayer Corporation under the names TRIAX 1120A and TRIAX 1120C, both having a flex modulus of approximately 170,000 psi. Known preferred types of TEXIN include products sold by the Bayer Corporation under the names TEXIN DP7-1102, having a flex modulus of approximately 37,000 psi, TEXIN 255, having a flex modulus of 20,000 psi, and TEXIN 250, having a flex modulus of 12,100 psi. Of course, any material or manufacturing method resulting in a material having the basic properties described above should work equally well.

Figure 9:
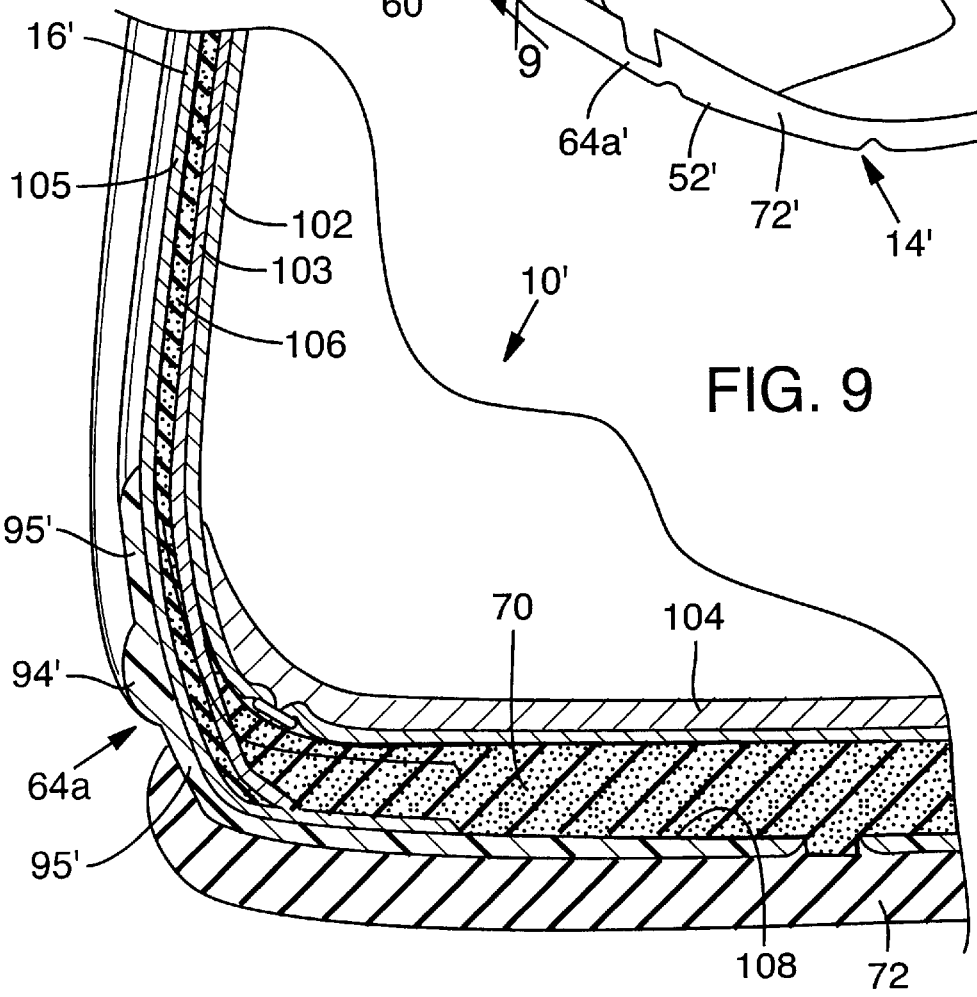
FIG. 9 is a fragmentary cross-sectional view of the shoe of FIG. 8 taken along line 9—9 of FIG. 8

As best shown in FIG. 9, the stabilizing member 55' is preferably secured between the midsole 70' and outsole 72' and adjacent to the upper 16' with known materials and methods, such as adhesive. Preferably, a sock liner 102' having a padded arch and foot support portion 104 is also installed in the upper 16'. More preferably, the upper 16' includes a thin layer of padding 106 sandwiched between an outer layer 105 and an inner layer 103 forming three layers of flexible upper material. The upper 16' is positioned between the c-shaped portions 56', 58' (56' shown) and the respective sides 64*a*, 64*b* (64*a* shown) of the midsole 70'. The padding 106, particularly in the area adjacent to the c-shaped members 56', 58' (56' shown), improves wearer comfort.

The generally c-shaped portions 56', 58' of the stabilizing member 55', when constructed and assembled as shown in FIGS. 8–14 allow the forefoot and heel portions 52', 50', respectfully, of the sole to axially twist with respect to each other in the direction of arrows 98' (FIGS. 10, 13A–13C) generally about axis L1', but resist movement in a direction of arrow 100 (FIGS. 10, 13A–C), generally transverse to a longitudinal length extending between said forefoot and heel portions 52', 50'.

The height of points P1' and P2' above the sole 14' of the shoe 10' determine the location of axis L1'. Positioning P1' below and forward of P2' as shown in FIG. 13C allows the shoe 10 to accommodate a wide variety of foot arch 87 sizes, including small arches, without compromising shoe comfort or axial flexibility. If additional medial stability is desired, known support members may be used, such as those disclosed in U.S. patent application titled "Inversion/Eversion limiting Support" and having Ser. No. 08/866,091 to Thomas Foxen et al., the disclosure of which is hereby incorporated by reference.

When the stabilizing member 55' is installed as described between the forefoot and heel portions 52', 56' of the sole 14', these portions 52', 56' may axially twist with respect to each other about axis L1' (FIG. 10), but resist movement in the direction of arrow 100' (FIG. 10). As a result, the forefoot and heel portions 52', 56' of the sole 14' may axially pivot about axis L1' located above the sole 14' of the shoe 10', while the sole 10' remains fully supported along its longitudinal length.

Preferably, the height of points P1' and P2' above the sole are selected so that axis L1' aligns with the axis of pronation 46 of the foot wearing the shoe. For example, in a men's size nine shoe, P1' can be approximately 1½ inches above the aft mounting portion 84' plus or minus ½ inch, and P2' can be approximately 2 inches above the aft mounting portion 84' plus or minus ½ inch, resulting in the frame 55' having axis L1' approximately 1¾ inches above the aft mounting portion, plus or minus a ½ inch, which is generally aligned with the axis of pronation 46 of an average men's size nine foot 12. Of course, these dimensions may be modified to accommodate the specific size and shape of a given foot.

C. Third Preferred Embodiment

Figure 15:
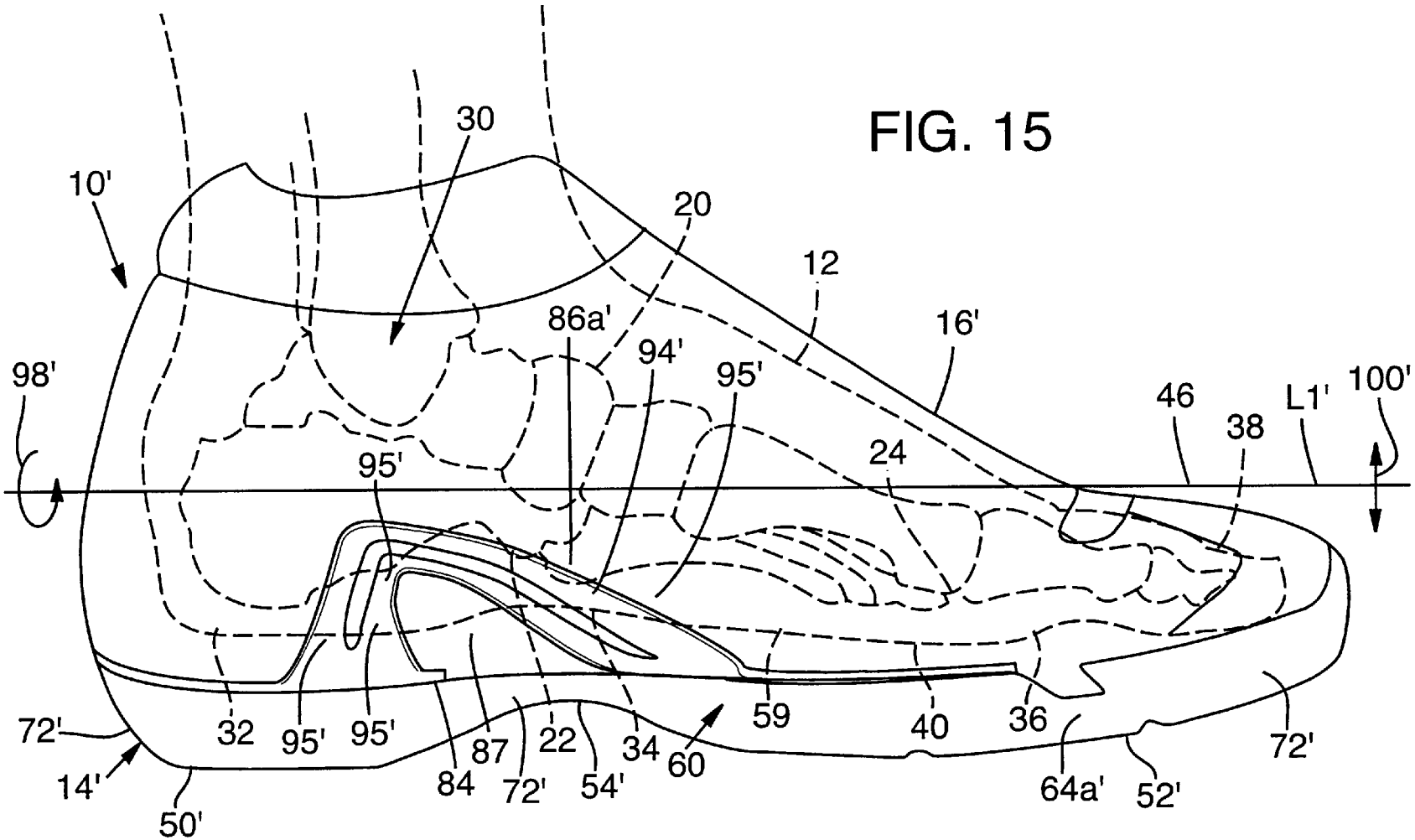
FIG. 15 is a side plan view of a shoe having a monolithic stabilizing band in accordance with a third preferred embodiment of the present invention with the outline of the medial view of a foot provided to show possible orientation the shoe with respect to an athlete's foot.

Referring to FIGS. 15–16, an article of footwear in accordance with a third preferred embodiment of the present invention, such as an athletic shoe, is generally shown as 10". Like numerals indicate like elements, with like elements between the first, second, and third preferred embodiments having like numerals.

Shoe 10" includes all the basic elements, construction, and utility as the second preferred embodiment. However, the frame 55' is a unitary or monolithic structure having medial and lateral c-shaped portions 56', 58' extending between a single fore mounting portion 82" and a single aft mounting portion 84".

Figure 16A:
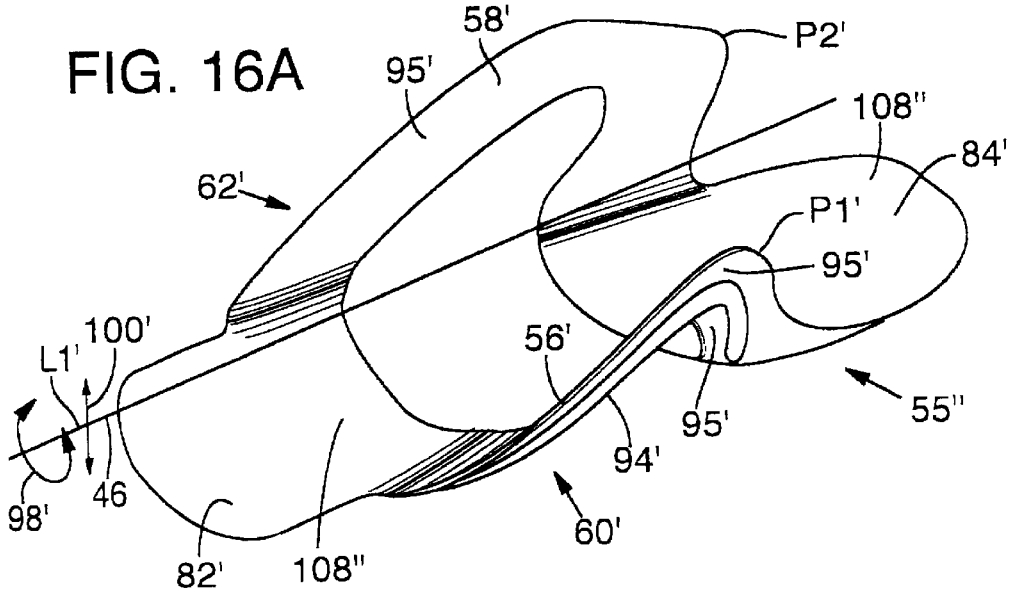
FIG. 16A is an enlarged isometric view of the stabilizing band of FIG. 15.
Figure 16B:
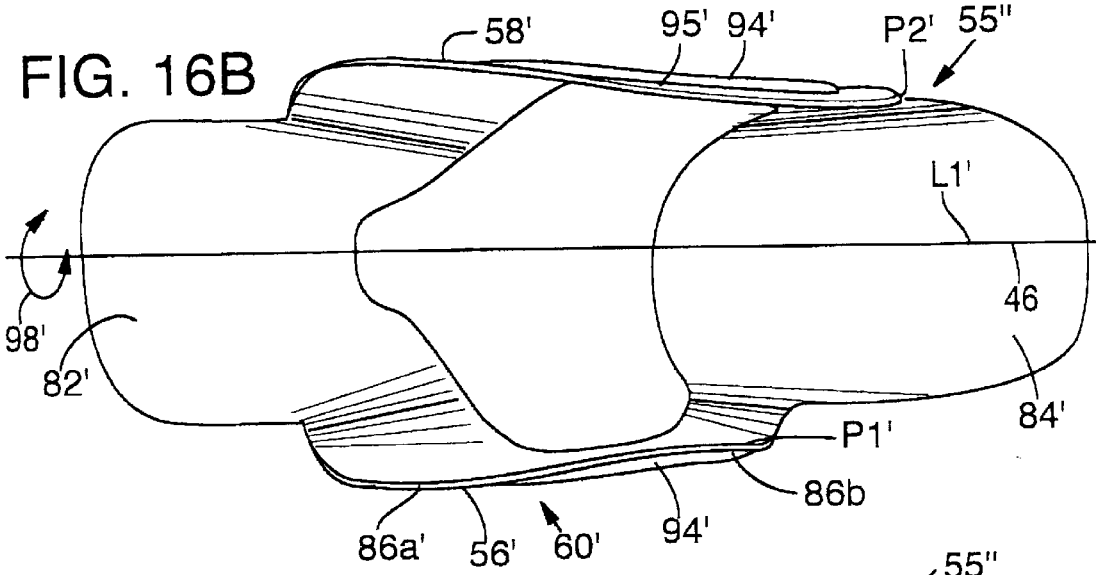
FIG. 16B is an enlarged to plan view of the stabilizing band of FIG. 16A.
Figure 16C:
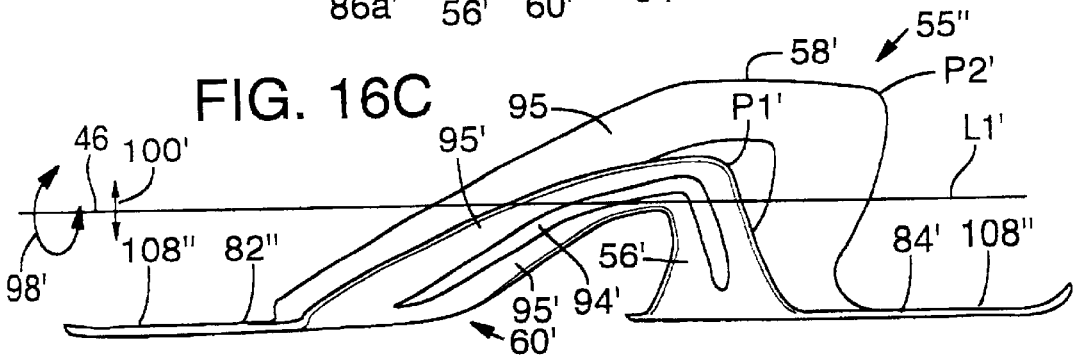
FIG. 16C is an enlarged side plan view of the stabilizing band of FIG. 16A.

As best shown in FIGS. 16A–C, the aft mounting portion 84" extends rearward from the c-shaped portions 56', 58' toward the rear of the shoe. The fore mounting portion 82" joins both the lateral and medial c-shaped portions 56', 58' and extends forward from the c-shaped portions 56', 58' toward the forefoot portion 52' of the sole 14'. Each mounting portion 82", 84" defines a planar surface 108' that preferably lie in substantially the same plane of each other.

The large mounting surfaces of the fore and aft mounting portions 82", 84" cover a large area of the heel and forefoot portions 50', 52' of the sole 14', thereby allowing the shoe 10' to operate equally well with different foot shape while improving the lateral stability of the shoe in the direction of arrow 100' (FIGS. 16A, 16C). Moreover, these large mounting areas provide a greater area of load dispersion when a cushioning or force adsorbing midsole (70, FIG. 1) is placed below the mounting portions 82", 84".

Having fully described the present invention and the preferred embodiments thereof, its use become apparent. An athlete wearing the shoes of the present invention simply begins running or engaging in athletic activity. While running, the heel portion and forefoot portions of the sole decouple or pivot with respect to each other such that they axially move with the foot about the foot's axis of pronation. However, the foot remains fully supported along its entire longitudinal length. Similarly, when an athlete steps improperly or rapidly changes his weight or direction, the forefoot and sole portions of the shoe decouple to provide a greater degree of stability, control, and maneuverability.

In view of the wide variety of embodiments to which the principles of the invention can be applied, it should be apparent that the detailed embodiments are illustrative only and should not be taken as limiting the scope of the invention. For example, the shape of the stabilizing bands and stabilizing rib may be modified to accommodate desired aesthetic goals without compromising the function of these elements. Rather, the claimed invention includes all such modifications as may come within the scope of the following claims and equivalents thereto.

What is claimed is:

1. An article of footwear having a heel region, an arch region, and a forefoot region comprising:

a sole having at least a heel portion in the heel region and a forefoot portion in the forefoot region;

an upper secured to the sole; and a semi-rigid stabilizing member extending from said forefoot region and through said arch region to said heel region, said stabilizing member including first and second arms, said first arm being connected to the footwear in said forefoot region adjacent said forefoot portion of said sole, said first arm extending both upwardly and backwardly in at least said forefoot region adjacent said forefoot portion of said sole, and said first arm extending into said arch region and to an apex, said second arm being connected to said footwear in said heel region adjacent said heel portion of said sole and extending upward to connect to the apex of said first arm, said first and second arms of said stabilizing member allowing said forefoot and heel portions of said sole to axial twist with respect to one another while generally resisting movement in a direction transverse to the longitudinal length of said sole.

2. The article of footwear of claim 1, wherein said stabilizing member is constructed of a semi-rigid material having a flex modulus between 10,000 and 300,000 psi.

3. The article of footwear of claim 2 wherein said frame means include a first material and a second material and said first material has a flex modulus higher than said second material.

4. The article of footwear of claim 3, wherein said first material has a flex modulus between 150,000 to 250,000 psi and said second material has a flex modulus between 10,000 to 40,000 psi.

5. The article of footwear of claim 1 wherein said longitudinal axis is positioned such that it aligned with an axis of pronation of a foot wearing the footwear.

6. The article of footwear of claim 1, wherein said first arm is connected to said forefoot portion of said sole, and said second arm is connected to said heel portion of said sole.

7. The article of footwear of claim 6, wherein said sole includes an outsole layer and a midsole layer, and said stabilizing member including fore and aft mounting portions, said fore mounting extending from said first arm and connected to said sole between said outsole and said midsole, and said aft mounting portion extending from said second arm and connected to said sole between said outsole and said midsole.

8. The article of footwear of claim 7, wherein said fore mounting portion and said aft mounting portion are generally planar surfaces.

9. The article of footwear of claim 7, wherein said outsole layer extends from said heel portion to said forefoot portion, and said outsole layer is a monolithic structure.

10. The article of footwear of claim 9, wherein said midsole and outsole lay include an arch portion between said heel and forefoot portions, and said outsole layer is narrow in said arch area to permit axial flex between said heel and forefoot portions.

11. The article of footwear of claim 1, wherein said stabilizing member includes a medial stabilizer formed of a first set of said first and second arms on a medial side of the footwear, and a lateral stabilizer formed of a second set of said first and second arms on a lateral side of said footwear.

12. The article of footwear of claim 11, wherein said stabilizing member is a monolithic structure.

13. The article of footwear of claim 11, wherein said first and second arms include a stiffening rib.

14. The article of footwear of claim 11, wherein said first and second arms include a first material and a second material, and said first material has a higher flex modulus than said second material.

15. The article of footwear of claim 14, wherein said first and second arms include a stiffening rib and a band portion wherein the stiffening rib includes the first material and the band portion includes the second material.

16. The article of footwear of claim 15, wherein the first material has a flex modulus between 150,000 to 250,000 psi and the second material has a flex modulus between 10,000 to 40,000 psi.

17. An article of footwear for a human foot, the foot having an ankle, forefoot, arch, and heel areas, a first cuneiform and cuboid bones, an axis of pronation, and first, second, third, fourth, and fifth metatarsal heads, the article of footwear comprising:

an upper;

a sole secured to the upper and having a heel portion, an opposite forefoot portion, and a flexible arch portion extending between the heel and forefoot portions for receiving the correspondingly named areas of the foot, and a stabilizing member extending between said sole forefoot and heel portions operably securing them to each other;

said stabilizing member having a generally c-shaped central portion extending above the heel and forefoot portions and adjacent to said upper, and including a lateral stabilizing portion and a medial stabilizing portion, with said central portion extending between generally planar fore and aft mounting portions;

said fore mounting portion of said medial stabilizing portion positioned in said forefoot portion of said sole such that it lies adjacent to the first and second metatarsal head of the foot;

said fore mounting portion of said lateral stabilizing portion positioned in said forefoot portion of said sole such that it lies adjacent to the third, fourth, and fifth metatarsal heads of the foot;

said aft mounting portion positioned in said sole portion of said heel portion of said sole such that it lies adjacent to the heel area of the foot;

said medial and lateral stabilizing portions extending from said fore mounting portion in a direction upwardly along the upper and generally arcuately backwardly to a point adjacent to the side of the foot below the ankle area and then generally arcuately downward to said aft mounting portion such that said heel and forefoot portions move with respect to each other generally axially about a longitudinal axis above the heel and forefoot portions of the sole while resisting movement in a direction transverse to the longitudinal length of the sole.

18. The article of footwear of claim 17, wherein said longitudinal axis is aligned with the axis of pronation of the foot.

19. The article of footwear of claim 17, wherein said medial and lateral stabilizing portions are two separate structures joined together to form said stabilizing member.

20. The article of footwear of claim 17, wherein said stabilizing member is a monolithic structure.

21. The article of footwear of claim 17, wherein said medial and lateral stabilizing portions include a include a stiffening rib.

22. The article of footwear of claim 17, wherein said medial and lateral stabilizing portions include a first material and a second material, and said first material has a higher flex modulus than said second material.

23. The article of footwear of claim 22, wherein said medial and lateral stabilizing portions include a stiffening rib and a band portion wherein the stiffening rib includes the first material and the band portion includes the second material.

24. The article of footwear of claim 23, wherein the first material has a flex modulus between 150,000 to 250,000 psi and the second material has a flex modulus between 10,000 to 40,000 psi and a Shore Hardness between 50–65 D.

25. An article of footwear for a human foot, the foot having an ankle, forefoot, arch, and heel areas, the article of footwear comprising:

an upper having a heel section, an opposite forefoot Section, and an arch section located between said heel and forefoot sections;

a sole secured to the upper, said sole having a heel portion, an opposite forefoot portion, and medial and lateral sides in both said heel and forefoot portions;

a semi-rigid stabilizing member extending between said forefoot and heel portions of said sole;

said stabilizing member including a lateral stabilizing portion and a medial stabilizing portion, each stabilizing portion having fore and aft mounting portions and a central portion extending between said fore and aft mounting portions, said central portion extending above the heel and forefoot portions of said sole and adjacent to said upper;

said fore mounting portion of said medial stabilizing portion fixed to said forefoot portion of said sole inward of said medial side of said sole;

said fore mounting portion of said lateral stabilizing portion fixed to said forefoot portion of said sole inward of said lateral side of said sole;

said aft mounting portion of said medial stabilizing portion fixed to said heel portion of said sole inward of the medial side of the sole;

said aft mounting portion of said lateral stabilizing portion fixed to said heel portion of said sole inward of the lateral side of the sole;

said medial and lateral stabilizing portions extending both upwardly and backwardly in at least an area adjacent said fore mounting portions, and said medial and lateral stabilizing portions extending along the upper to points located adjacent to the sides of the ankle area and then generally downward to said aft mounting portions such that said heel and forefoot portions move with respect to each other generally axially about a longitudinal axis above the heel and forefoot portions of the sole while resisting movement in a direction transverse to the longitudinal length of the sole.

* * * * *

UNITED STATES PATENT AND TRADEMARK OFFICE

CERTIFICATE OF CORRECTION

PATENT NO. : 6,401,366 B2
DATED : June 11, 2002
INVENTOR(S) : Thomas Foxen et al.

It is certified that error appears in the above-identified patent and that said Letters Patent is hereby corrected as shown below:

Column 12,
Line 37, change “lay” to -- layers --.

Signed and Sealed this

Twenty-fifth Day of February, 2003

JAMES E. ROGAN
*Director of the United States Patent and Trademark Office*